US005564964A

United States Patent [19]

Chin-Chien

[11] Patent Number: 5,564,964

[45] Date of Patent: Oct. 15, 1996

[54] TOY GUN WITH HELICALLY DRIVEN RECIPROCATING BARREL

[76] Inventor: Lin Chin-Chien, No. 19, Lane 70, Din Mei 1st Road, Tainan, Taiwan

[21] Appl. No.: 295,962

[22] Filed: Aug. 25, 1994

[51] Int. Cl.[6] ..... A63H 5/04

[52] U.S. Cl. ..... 446/406; 446/473; 89/161; 42/54

[58] Field of Search ..... 446/473, 406, 446/405, 377, 356, 144, 145, 407, 397, 401; 42/54, 57, 58, 55, 10, 11; 89/9, 161

[56] References Cited

U.S. PATENT DOCUMENTS

| | | | |
|---|---|---|---|
| 3,010,729 | 11/1961 | Tomosy | 446/356 |
| 3,181,423 | 5/1965 | Rocha | 89/161 |
| 3,327,587 | 6/1967 | Reed et al. | 89/161 |
| 3,331,463 | 7/1967 | Kramer | 446/353 |
| 4,808,143 | 2/1989 | Kieo | 446/473 |
| 5,283,970 | 2/1994 | Aigner | 446/406 |

*Primary Examiner*—Robert A. Hafer
*Assistant Examiner*—Michael O'Neill
*Attorney, Agent, or Firm*—Pro-Techtor International

[57] ABSTRACT

A toy gun includes two discs secured in a gun barrel. A roller is rotatably supported between the discs and has three helical grooves. Three tubes are slidably extended through one of the discs and are engaged with the helical grooves of the roller such that the tubes are moved in reciprocating action when the roller is rotated. Three light bulbs are disposed in the tubes, and the tubes are made of transparent materials having different colors such that different colors are generated through the tubes when the light bulbs are energized.

4 Claims, 4 Drawing Sheets

TOY GUN WITH HELICALLY DRIVEN RECIPROCATING BARREL

BACKGROUND OF THE INVENTION

1. Field of the Invention

The present invention relates to a toy gun, and more particularly to a toy gun having tube members operating in reciprocating actions.

2. Description of the Prior Art

Typical toy guns comprise a gun body having a gun barrel that is solidly secured to the gun body and that may not be moved relative to the gun body. The toy guns may include means for generating light in the gun barrels.

The present invention has arisen to mitigate and/or obviate the afore-described disadvantages of the conventional toy guns.

SUMMARY OF THE INVENTION

The primary objective of the present invention is to provide a toy gun which include tube members that may be moved in reciprocating action.

In accordance with one aspect of the invention, there is provided a toy gun comprising a gun barrel, two discs secured in the gun barrel, a first of the discs including at least one rod extended therefrom, at least one light bulb secured to the rod, a roller rotatably supported between the discs and including at least one helical groove formed therein, at least one tube member slidably engaged on the rod and extended through a second of the discs and including a slide slidably engaging with the helical groove of the roller, the tube member being moved in reciprocating action when the roller is rotated, and means for rotating the roller so as to move the tube member in reciprocating action.

The second disc includes at least one hub formed thereon, the toy gun further comprising a second gun body including at least one sleeve for engaging with the hub so as to be secured to the hub, and an axle rotatably supported therein, and means for coupling the rotating means to the axle for rotating the axle.

The gun barrel includes a channel formed therein, the toy gun further comprising a second gun body including an engaging means for engaging with the channel, and an axle rotatably supported therein, and means for coupling the rotating means to the axle for rotating the axle. The gearing means includes a pinion extended inward of the channel, the second gun body includes a second gearing means coupled to the axle and includes a gear for engaging with the pinion.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
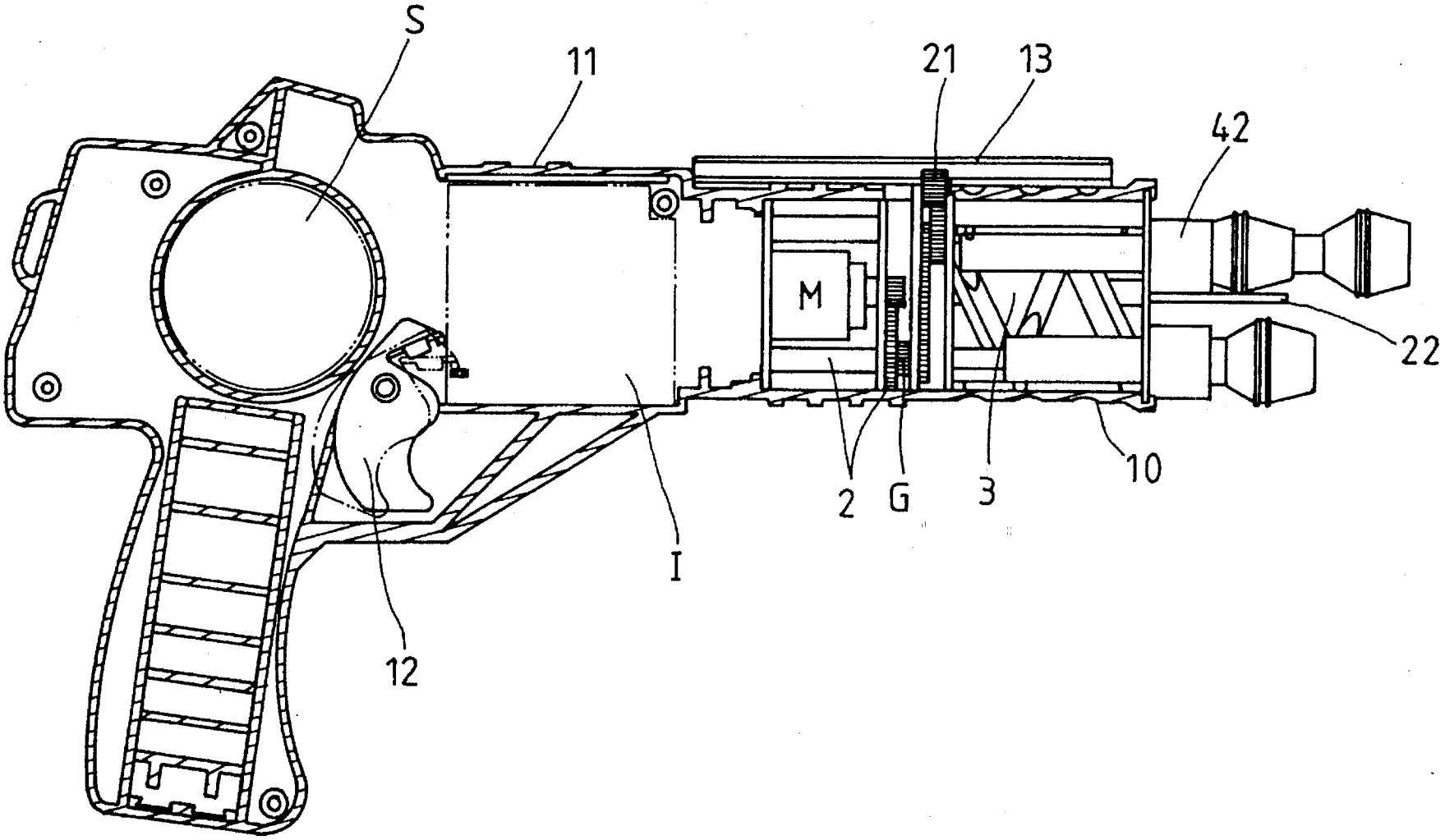
FIG. 1 is a cross sectional view of a toy gun in accordance with the present invention.

Referring to the drawings, and initially to FIG. 1, a toy gun in accordance with the present invention comprises a body 11 including a speaker S and an electric board I disposed therein and including a trigger 12 for operating the toy gun, the body 11 includes a gun barrel 10 having a driving means 2 including a motor M and gearing means G disposed therein. A channel 13 is formed on top of the gun barrel 10. The gearing means G includes a pinion 21 extended inward of the channel 13.

Figure 2:
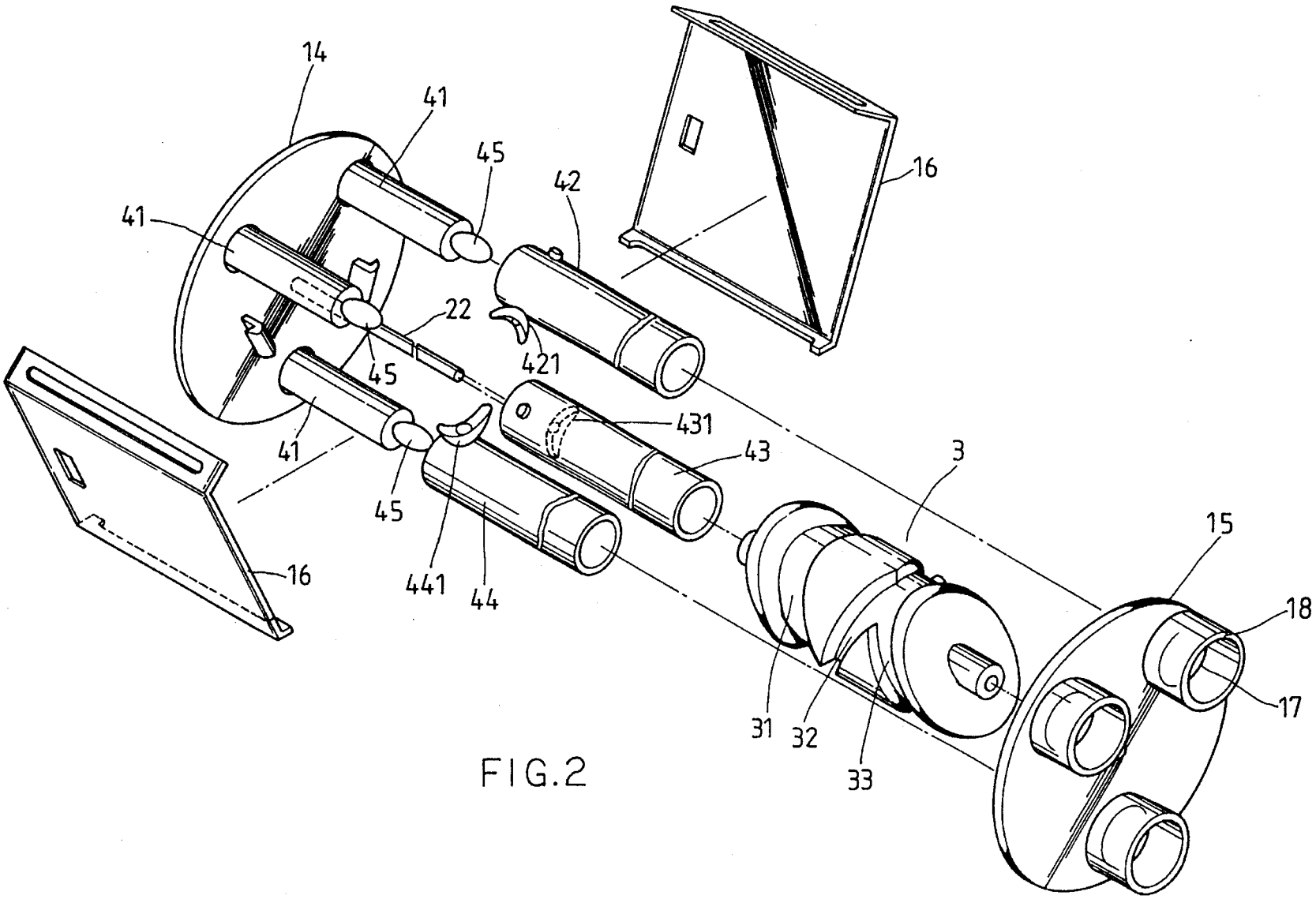
FIG. 2 is a partial exploded view of the toy gun.

Referring next to FIG. 2, and again to FIG. 1, two discs 14, 15 are fixed in the gun barrel 10 and two boards 16 are secured to the discs 14, 15 by hooks and openings, for example. A shaft 22 extends through the discs 14, 15 and is rotatably supported by the discs. The shaft 22 is engaged with the gearing means G so as to be driven by the motor M. A roller 3 is fixed on the shaft 22 and is rotatably supported between the discs 14, 15 and includes three helical grooves 31, 32, 33 formed therein and communicating with one another. The disc 14 includes three rods 41 extended therefrom and three light bulbs 45 secured to the free end portions of the rods 41 respectively and connected to the circuit board I. The other disc 15 includes three hubs 18 each having a hole 17 formed therein. Three tube members 42, 43, 44 are slidably engaged on the rods 41 and slidably extended through the hubs 18, the tube members each includes a slide 421, 431, 441 for slidably engaging with the helical grooves 31, 32, 33 of the roller 3 respectively. It is preferable that the tube members 42, 43, 44 are transparent having different colors.

Figure 3C:
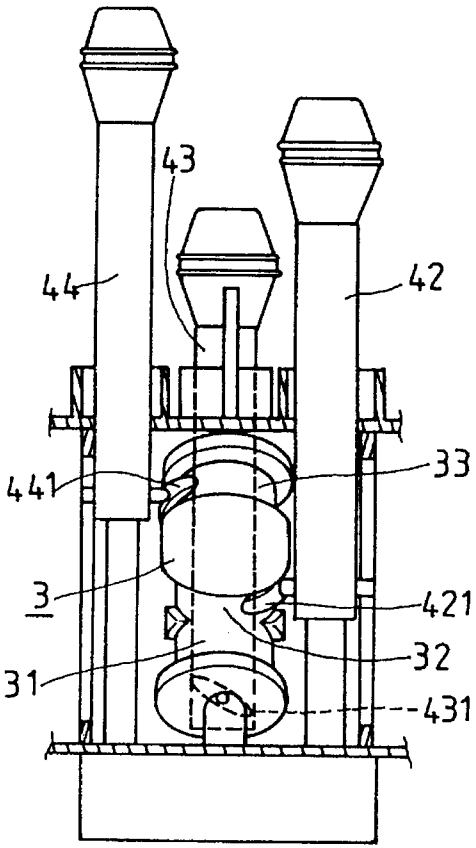
FIGS. 3A, 3B, 3C are schematic views illustrating the operation of the toy gun.
Figure 3B:
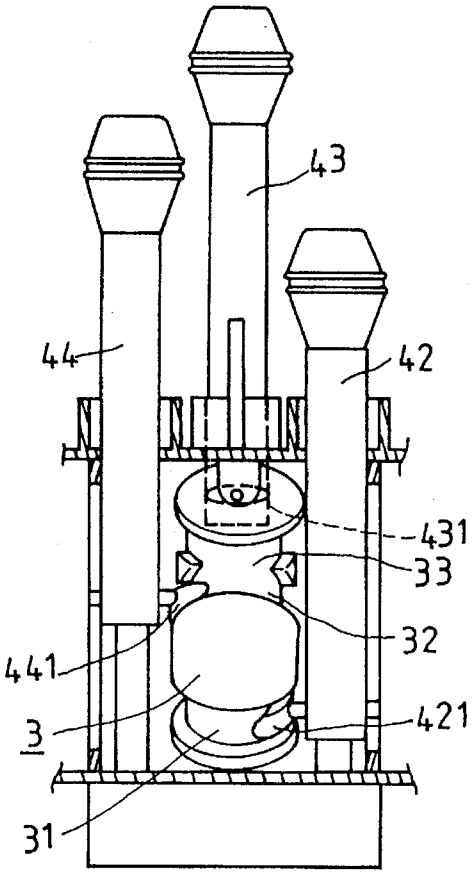
Figure 3A:
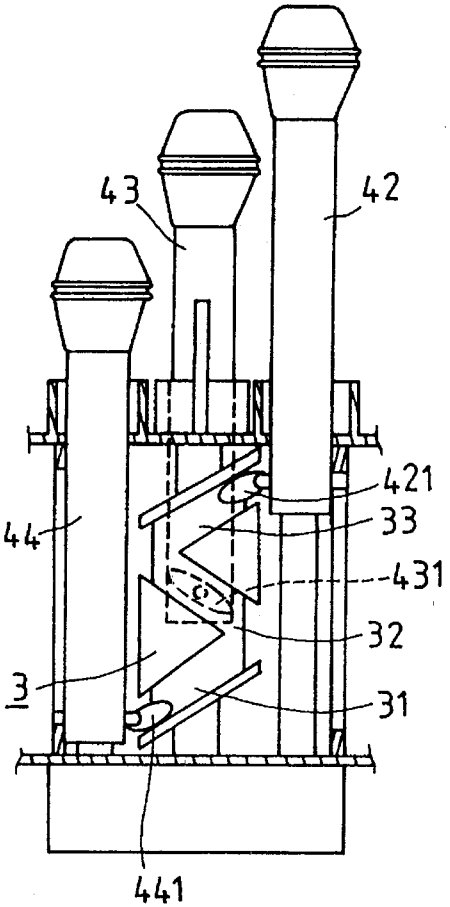

In operation, as shown in FIGS. 3A, 3B, 3C, when the electric board I is switched on by the trigger 12, the speaker S may generate sound and the light bulbs 45 may generate lights, and both the shaft 22 and the roller 3 may be rotated by the motor M. The tube members 42, 43, 44 are caused to move in reciprocating actions by sliding engagement of the slides 421, 431, 441 within the helical grooves 31, 32, 33. Lights of different colors are generated by the lights of the light bulbs 45 emitted through the tube members of different colors.

Figure 4:
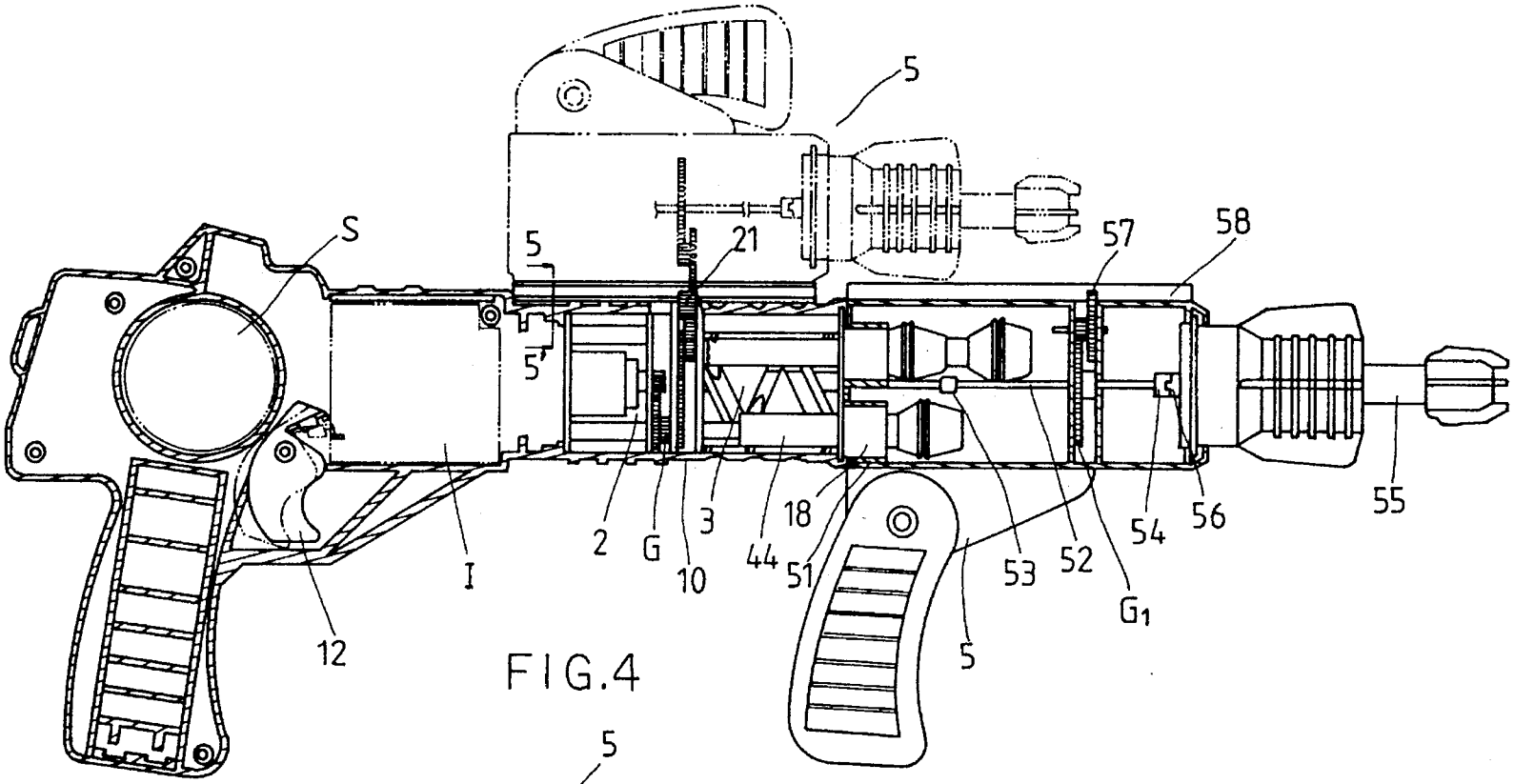
FIG. 4 is a cross sectional view illustrating the application of the toy gun.

Referring next to FIG. 4, a further gun body 5 may be secured to the gun body 11. The gun body 5 includes a hollow rear portion having three sleeves 51 for engaging with the hubs 18, a spindle 52 provided in the gun body 5 and connected to the shaft 22 by a connector 53, gearing means G1 coupled to the spindle 52, and an axle 55 coupled to the gearing means G1 by connecting means 54, 56 such that the axle 55 may be rotated by the motor M.

Figure 5:
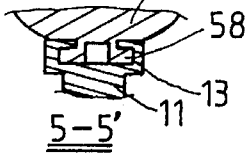
FIG. 5 is a partial cross sectional view taken along lines A–A' of FIG. 4.

Referring next to FIG. 5 and again to FIG. 4, the gun body 5 may includes a dovetail 58 formed therein for engaging with the channel 13 of the gun body 11 as shown in dotted lines in FIG. 4, such that the gun body 5 may be secured on top of the gun barrel 10. The gearing means G1 includes a gear 57 for engaging with the pinion 21 such that the axle 55 may also be rotated by the motor M.

Accordingly, the toy gun in accordance with the present invention includes tube members that may be actuated to move in reciprocating actions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toy gun comprising:

a gun barrel, two discs secured in said gun barrel, a first of said discs including at least one rod extended therefrom, at least one light bulb secured to said rod, a roller rotatably supported between said discs and including at least one helical groove formed therein, at least one tube member slidably engaged on said rod and extended through a second of said discs and including a slide slidably engaging with said helical groove of said roller, said tube member being moved in reciprocating action when said roller is rotated, and means for rotating said roller so as to move said tube member in reciprocating action.

2. A toy gun according to claim 1, wherein said second disc includes at least one hub formed thereon, said toy gun further comprising a second gun body including at least one sleeve formed thereon for engaging with said hub so as to be secured to said hub, and an axle rotatably supported therein, and means for coupling said rotating means to said axle for rotating said axle.

3. A toy gun according to claim 1, wherein said gun barrel includes a channel formed therein, said toy gun further comprising a second gun body including an engaging means for engaging with said channel, and an axle rotatably supported therein, and means for coupling said rotating means to said axle for rotating said axle.

4. A toy gun according to claim 3, wherein said gearing means includes a pinion extended inward of said channel, said second gun body includes a second gearing means coupled to said axle and includes a gear for engaging with said pinion.

* * * * *